US006158990A

United States Patent [19]

Kimura et al.

[11] Patent Number: 6,158,990

[45] Date of Patent: Dec. 12, 2000

[54] SCROLL MEMBER FOR A SCROLL TYPE OF FLUID MACHINERY AND SCROLL TYPE OF FLUID MACHINERY PRODUCED THEREBY

[75] Inventors: Yoshio Kimura, Maebashi; Hideto Shimizu, Isesaki, both of Japan

[73] Assignee: Sanden Corporation, Gunma, Japan

[21] Appl. No.: 09/056,796

[22] Filed: Apr. 8, 1998

[30] Foreign Application Priority Data

Apr. 10, 1997 [JP] Japan ..... 9-092115

[51] Int. Cl.[7] ..... F01C 1/02

[52] U.S. Cl. ..... 418/55.2

[58] Field of Search ..... 418/55.2

[56] References Cited

U.S. PATENT DOCUMENTS

| | | | |
|---|---|---|---|
| 3,802,809 | 4/1974 | Vulliez . | |
| 3,884,599 | 5/1975 | Young et al. . | |
| 4,303,379 | 12/1981 | Hiraga et al. . | |
| 4,304,535 | 12/1981 | Terauchi . | |
| 4,666,380 | 5/1987 | Hirano et al. . | |
| 4,824,345 | 4/1989 | Fukuhara et al. . | |
| 5,320,505 | 6/1994 | Misiak et al. | 418/55.2 X |
| 5,478,220 | 12/1995 | Kamitsuma et al. | 418/55.2 |
| 5,730,588 | 3/1998 | Terai et al. | 418/55.2 |
| 5,951,270 | 9/1999 | DuMoulin et al. | 418/55.2 |

FOREIGN PATENT DOCUMENTS

| | | |
|---|---|---|
| 0429146 | 4/1987 | European Pat. Off. . |
| 57-147618 | 8/1982 | Japan . |
| 5937289 | 2/1984 | Japan . |
| 60-222580 | 11/1985 | Japan . |
| 452842 | 8/1992 | Japan . |

OTHER PUBLICATIONS

European Search Report mailed Jun. 4, 1998.

*Primary Examiner*—Hoang Nguyen
*Attorney, Agent, or Firm*—Baker Botts L.L.P.

[57] ABSTRACT

In order to increase productivity of spiral machining, to provide a low-cost scroll member for a scroll type of fluid machinery, and to provide a scroll type of fluid machinery that does not generate a burr in a base plate surface at the time of finishing, a scroll member (39) has a spiral element (43) formed in a spiral shape around an axis and a base plate (41) provided in one piece in an end face of the spiral element (43) in an axial direction. In addition, the scroll member (39) compresses fluid with forming a fluid pocket between the spiral elements by performing swing motion that is prevented from relatively rotating to a counterpart of scroll member having a spiral element meshing with the spiral element (43) and a base plate facing to the base plate (41). A chamfered section (149) is formed in a bare surface on the base plate surface (141) on an extension line (89) of an inner wall surface's spiral end of this spiral element (43) wall surface so that a distance from the extension line of the spiral end toward the center may be within a range less than the thickness of a spiral element's wall of the counterpart of scroll member.

17 Claims, 12 Drawing Sheets

SCROLL MEMBER FOR A SCROLL TYPE OF FLUID MACHINERY AND SCROLL TYPE OF FLUID MACHINERY PRODUCED THEREBY

BACKGROUND OF THE INVENTION

1. Field of the Invention

The present invention relates to a scroll member for a scroll type of fluid machinery and the scroll type of fluid machinery produced thereby, and in particular, to a scroll type of fluid machinery, which is used for a refrigeration circuit of an air conditioner mounted in a vehicle, and a scroll member used therefor.

2. Description of the Related Art

Heretofore, a scroll type of fluid machinery has two scroll members combined together. Each of the scroll members has a spiral element formed in a spiral shape around an axis and a base plate provided at an end face of this spiral element in an axial direction in one piece. With combining two scroll members, one side of scroll member is located within spiral gaps by another side of spiral element, and is contacted with another side of spiral element as well. In this manner, a closed space confining fluid between both spiral elements is formed.

One side of scroll member is fixed (hereinafter, this is called a "fixed scroll member"). In addition, although another side of scroll member performs swing motion that is near to a circle along a circular orbit, its rotation about a shaft is prevented (hereinafter, this is called a "movable scroll member").

When the scroll type of fluid machinery is operated, the movable scroll member is driven by a motor and the like. The above-mentioned closed space is carried toward the center along the spiral by relative swing motion of the movable scroll member to the fixed scroll member. In consequence, the fluid can be compressed.

Heretofore, end milling is used for machining of a wall surface of the spiral element when the scroll member is manufactured. However, since high precision is necessary in both of surface roughness and positional accuracy, productivity of spiral machining is extremely low.

Furthermore in prior art, burrs arise in circumference of a base plate surface when a part of the base plate surface that is nearer to the center than an extension line of an inner wall surface of the spiral element is finished. In the subsequent process, removal of the burrs is required. Hence, the prior art has a disadvantage of many machining processes.

Moreover in the prior art, only a base plate is machined on the extension line from the spiral end of the spiral inner wall. Therefore, the top of an end mill is worn away earlier than the side face of the end mill, and hence, tool life becomes short. This is a reason why a tooling cost increases.

On the other hand, a scroll member is disclosed in the prior art (Japanese Patent Publication (JP-B) No. 4-52842), the scroll member whose spiral element has a part of an outer wall surface that is an area from its spiral end to at most half of the circumference and has a bare surface, that is casting surface. This scroll member has a problem that burrs arise in an outer edge section, and in particular, on the boundary between an area that is left in a bare surface and a machined surface in the base plate section.

Further in the fixed scroll member that is composed of the scroll member and a casing in one piece, it should be machined with an end mill to an intake pocket section for sucking gas, and, therefore, has a disadvantage that productivity is further low, and hence, its cost increases.

SUMMARY OF THE INVENTION

It is an object of the present invention to provide a scroll member for a scroll type of fluid machinery for increasing productivity of spiral machining.

In addition, it is another object of the present invention to provide a low-cost scroll member for a scroll type of fluid machinery.

Further, it is still another object of the present invention to provide a scroll member for a scroll type of fluid machinery where a burr does not arise in the base plate surface at the time of finishing.

Furthermore, it is yet another object of the present invention to provide a scroll type of compressor providing the above-mentioned scroll member for a scroll type of fluid machinery.

According to one aspect of the present invention, there is provided a scroll type of fluid machinery which comprises a drive mechanism driven by a drive shaft, a scroll member having a first spiral element formed in a spiral shape around an axis and a first base plate provided in one piece on an end face of the first spiral element in an axial direction, and a counterpart of scroll member having a second spiral element meshing with the first spiral element and a second base plate facing to the first base plate.

In the fluid machine, the drive mechanism performs rotation-prevented swing motion of the first spiral element relative to the counterpart of scroll member so that the fluid machinery forms a fluid pocket between the first and the second spiral elements to compress fluid in the fluid pocket.

In the fluid machinery, the scroll member has a chamfered section formed in the base plate surface and extending along an extension line of an inner wall surface's spiral end of the spiral element to have an inner section and an outer section which are divided with respect to said extension line. The inner section has a width less than a thickness of the second spiral element. The chamfered section has a bare surface.

According to another aspect of the present invention, there is provided a scroll member having a spiral element formed in a spiral shape around an axis and a base plate provided in an end face of this spiral element in an axial direction in one piece. The scroll member has a chamfered section formed in the base plate surface and extending along an extension line of an inner wall surface's spiral end of said spiral element to have an inner section and an outer section which are divided with respect to the extension line. The chamfered section has a bare surface.

Here, in a scroll member for a scroll type of fluid machinery according to the present invention, it is preferable that an base plate surface outside the chamfered section is formed at one step lower than a base plate surface inside the first spiral element, and the outside base plate surface or a surface defining a circumference of the base plate surface is formed in a bare surface.

In addition, in a scroll member for a scroll type of fluid machinery, it is preferable that a chamfered section is formed in a bare surface on a wall surface corresponding to an inner wall's end section of the spiral element of the base plate.

Furthermore in a scroll member for a scroll type of fluid machinery, it is preferable that a concave portion is provided in a portion corresponding to the outer wall surface's end section of the spiral element of the base plate, and a chamfered section is formed in a bare surface in an area contacting to the concave section and at least the outer wall surface and a surface of the base plate that is machined.

Moreover in a scroll member for a scroll type of fluid machinery, it is preferable that the spiral element is a first spiral element formed in a spiral shape around an axis, the base plate is a first base plate provided in one piece on an end face of the first spiral element in an axial direction, and further, the scroll member is a scroll member for a scroll type of fluid machinery compressing fluid with forming a fluid pocket between the first spiral element and the second spiral element by performing swing motion that is prevented from relatively rotating to the counterpart of scroll member having a second spiral element meshing with the first spiral element and a second base plate facing to the first base plate.

DESCRIPTION OF THE PREFERRED EMBODIMENTS

Before description of preferred embodiments, a scroll type of fluid machinery based on prior art and a scroll member used for it will be described with reference to drawings for better understanding of the present invention.

Figure 1:
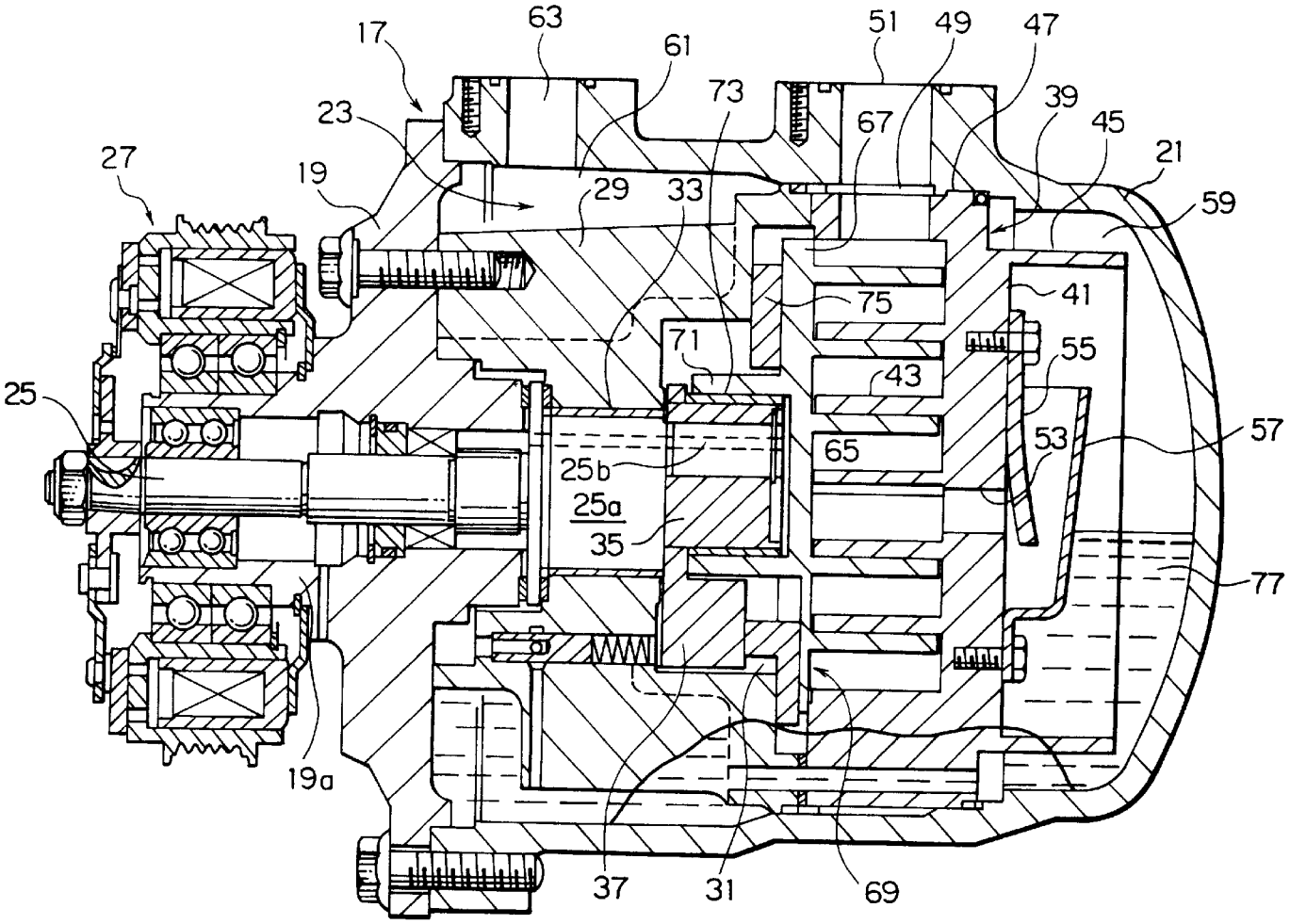
FIG. 1 PRIOR ART
FIG. 1 is a cross-sectional view showing a conventional scroll type of fluid machinery.

Referring to FIG. 1, a scroll type of fluid machinery 17 comprises a front plate 19 that is an outer shell, and a casing 21. An internal space 23 of the fluid machinery is defined with the front plate 19 and casing 21. A shaft 25 is rotatably located at the end of the machinery and reaches the internal space 23 of the fluid machinery with passing through the front plate 19 from the external. In addition, an electromagnetic clutch 27 is located around a projecting section of the front plate 19 for transferring rotational torque to the shaft 25.

In the internal space 23 of the fluid machinery, a main housing 29 is provided adjacent to the front plate 19 with forming a crankcase 31. One end of the shaft 25 is contained in the main housing 29 and is formed into a large-diameter section 25*a*, which is supported by the main housing 29 via bearings 33. Further, the shaft 25 extends into the crankcase 31, and is terminated by an eccentric pin 25*b*. An eccentric bush 35 is provided around the eccentric pin 25*b*. Around the eccentric bush 35, a counter balance weight 37 is provided. A fixed scroll member 39 is located in the rear end of the crankcase 31. The fixed scroll member 39 comprises a base plate 41 and a spiral element 43 at one end of the base plate 41. In addition, the fixed scroll member 39 comprises a cylindrical projecting section 45 at another end of the base plate 41. A fixed section 47 is around the base plate 41 and is fixed between an inner wall of the casing 21 and one end of the main housing 29.

Furthermore, a communication hole 49 is provided in a part around the fixed part 47 of the base plate 41 and communicates with an intake pocket as described later. This communication hole 49 communicates with an intake port 51 of the casing 21. In addition, a discharge opening 53 is opened in the center portion of the base plate 41 with passing through this base plate 41. A discharge valve mechanism 55 is provided so as to cover an opening portion of the discharge opening 53. On the other hand, a baffle 57 is provided so as to cover this discharge valve mechanism 55. This baffle 57 has a function of separating lubricant oil included in discharged fluid. A discharge chamber 59 is connected to a sub-discharge chamber 61 in the upper side of the main housing 29 through a communication hole not shown. The sub-discharge chamber 61 communicates with a discharge port 63 provided in the casing 21.

With facing to the fixed scroll member 39, a movable scroll member 69 is provided which has in one side of a base plate 67 a spiral element 65 meshing with the spiral element 43 of the fixed scroll member 39. In another side of the base plate 67 of the movable scroll member 69, a cylindrically projecting boss section 71 is provided. In the boss section 71, the eccentric bush 35 is contained via bearings 73 as mentioned above.

For making the movable scroll member 69 perform swing motion that is prevented from rotating on its own axis, a drive mechanism is constructed of the large-diameter section 25*a*, the eccentric pin 25*b*, eccentric bush 35, the bearings 73, and the boss section 71.

In another face of the movable scroll member 69, an Oldham's coupling 75 is provided between the vicinity of the boss section 71 and the main housing 29 as a rotation preventing mechanism. Further, reference numeral 77 shows lubricant.

In the scroll type of fluid machinery having construction like this, the movable scroll member is prevented from rotating on its own axis and performs swing motion relative to the fixed scroll member 39 through the drive mechanism acting by rotation of the shaft 25. By this swing motion, fluid is taken in from the intake port 51 into a fluid pocket formed between the scroll members 39 and 69, and moves to the center between the scroll members 39 and 69. Then the fluid is discharged to the discharge chamber 59 via the discharge opening 53. In addition, the fluid moves from the discharge chamber 59 to the sub-discharge chamber 61 through a discharge path not shown, and is discharged from the discharge port 63.

Figure 2:
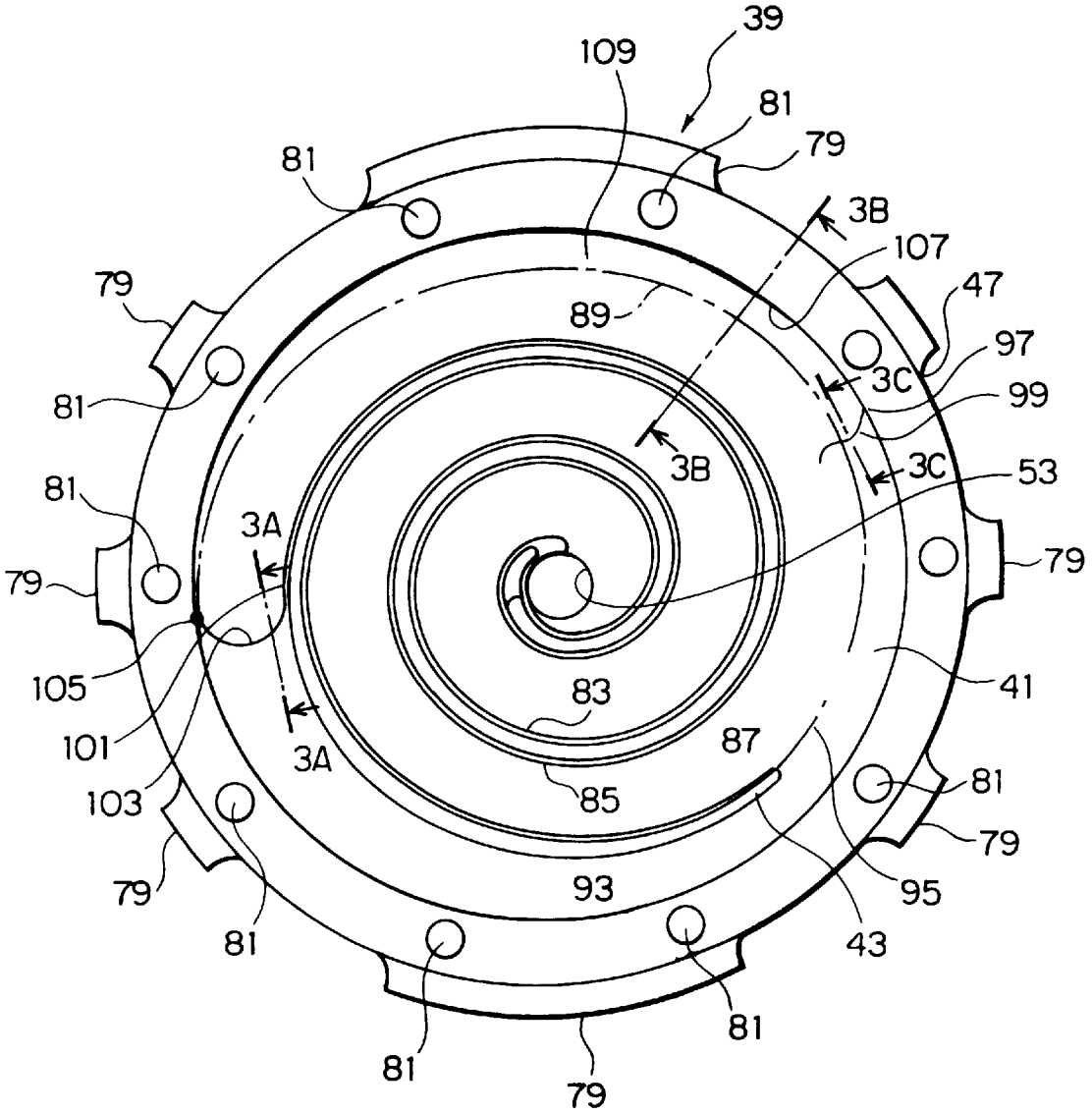
FIG. 2 PRIOR ART
FIG. 2 is a front view showing an example of a scroll member based on prior art.

As shown in FIG. 2, a fixed scroll member 39 is shown as an example of conventional scroll member. The fixed scroll member 39 comprises the base plate 41, and a spiral element 43 projecting from one face of the base plate 41. A fixed section 47 is provided around the base plate 41 for fixing to the casing 21 shown in FIG. 1. The fixed section 47 is formed with projecting in this side more than the base plate 41. In addition, a projecting piece 79 is formed for fixing around the fixed section 47. Furthermore, the fixed section 47 comprises a plurality of through holes 81 that become paths of fluid or lubricant.

In the center of the spiral element 43, a discharge opening 53 is provided for discharging compressed fluid. The spiral element 43 constructs a spiral wall that is a projecting belt defined by an inner wall surface 83 and an outer wall surface 85 so that the spiral element 43 may draw an involute curve with this discharge opening 53 as the center. An inside base plate surface 87 is extended to a fixed point 105 on a virtual involute curve 89 obtained by extending the involute curve drawn by the inner wall surface 83 of the spiral element 43. The inside base plate surface 87 is formed on the virtual involute curve 89 at one step lower than the surrounding outside base plate surface 93 with forming a vertical surface 95. The vertical surface 95 is formed in an arc 99 from the fixed point 91 toward the external to a fixed point 97 on a wall surface that is a intersection with the fixed section. The arc is completed at the fixed point 97.

In addition, a vertical surface 103 is formed in an arc from a fixed point 101 of the outer wall surface 85 of the spiral element 43 to a wall surface 105 of the fixed section 47. The arc is completed at the wall surface 105.

Figure 3A:
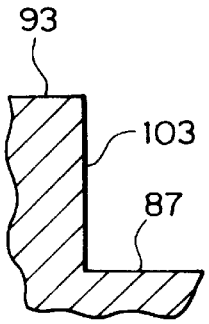
FIG. 3A PRIOR ART
FIGS. 3A, 3B, and 3C are cross-sectional views taken on lines 3A—3A, 3B—3B, and 3C—3C of FIG. 2 respectively.

Therefore, it is easily understood from FIG. 3A that the outside base plate surface 93 and the inside base plate surface 87 form stepwise construction with a vertical surface 103.

Figure 3B:
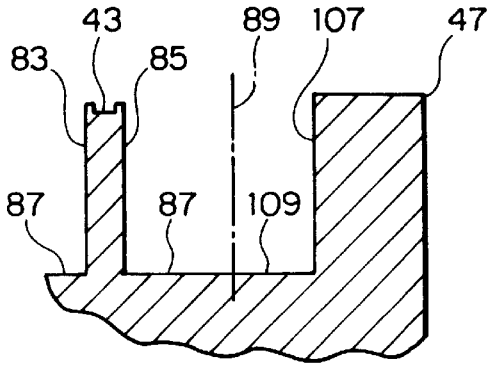
FIG. 3B PRIOR ART

In addition, it is easily understood from FIG. 3B that an outside base plate surface 109 that is the same plane as the inside base plate surface 87 is formed between the outer wall surface 85 of the upper spiral element 43 in FIG. 2 and an inner surface 107 of the fixed section 47.

Figure 3C:
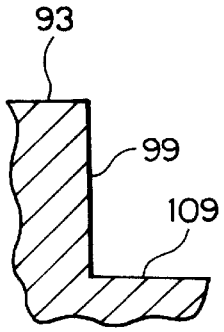
FIG. 3C PRIOR ART

On the other hand, it is easily understood from FIG. 3C that the outside base plate surface 93 and the outside base plate surface 109 form stepwise construction with a vertical surface 95 and a vertical surface 99. Although these are not shown, the inside base plate surface 87 and the outside base plate surface 93 form stepwise construction with a vertical surface 95. Here, the outside base plate surface 109 that is positioned outside the virtual involute curve 89 that is an extension line of the inner wall surface of the spiral element 43 is in the same plane as the inside base plate surface 87.

By the way, a raw scroll member is, first, formed by molding to have an approximately similar shape in a production of the above-mentioned scroll member 39. After that, finishing is, in turn, carried out with an end mill or an grindstone of the inner wall surface 83, outer wall surface 85, inside base plate surface 87, and outside base plate surface 109 of the spiral element 43, in turn. Thus, a grinding tool is prepared which is composed of an end mill or a grindstone whose diameter is smaller than a gap between the walls of the spiral element 43. The grinding tool is located in a spiral gap, and is moved along the spiral shape. Concretely, a finish is carried out simultaneously of a wall surface and a base plate surface so as to finish both of the inner wall surface 83 and inside base plate surface 87, or both of the outer wall surface 85 and the inside base plate surface 87. However, only the base plate surface is given finishing on the extension line 89 from the spiral end of the inner wall because of no wall surface. Thus, semi-finish and finish with end mill machining are performed of the inside base plate surface 87, outside base plate surface 109, inner circumference surface 107 of the fixed section, vertical surface 99, vertical surface 103 of the end section of the outer wall surface, and vertical surface 95 on the extension line of the inner wall surface.

Figure 4:
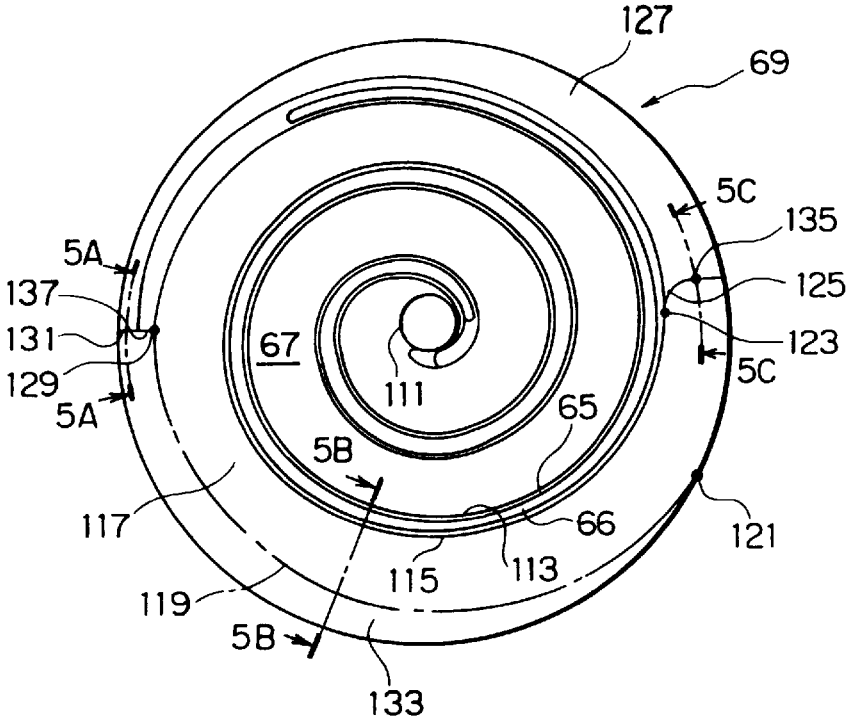
FIG. 4 PRIOR ART
FIG. 4 is a front view showing another example of a scroll member based on prior art.

Referring to FIG. 4, the movable scroll member 69 is shown as another example of the conventional scroll member. This movable scroll member 69 comprises a base plate 67, and a spiral element 65 projecting from a surface of the base plate 67. A circumference surface is formed around the base plate 67.

A spiral wall is a projecting belt defined by an inner wall surface 113 and an outer wall surface 115 and is constructed so that an involute curve may be drawn from a reference circle 111 that is at the center of the spiral element 65.

An inside base plate surface 117 is formed to a fixed point 121 of a virtual involute curve 119 that is extension of an involute curve drawn by the inner wall surface 113 of the spiral element 65.

An outer wall surface 115 is completed at a fixed point 123. A machined surface identical with the base plate surface 117 is formed from this fixed point 123 indicating a termination through the fixed point 125 to the circumference surface. In the outside portion of the involute curve of the outer wall surface 115 from this end surface of the machined base plate surface to an end 129 of the involute curve of the inner wall surface 113, the outer wall surface 115 is formed higher than the machined base plate surface, and is a bare surface.

Figure 5A:
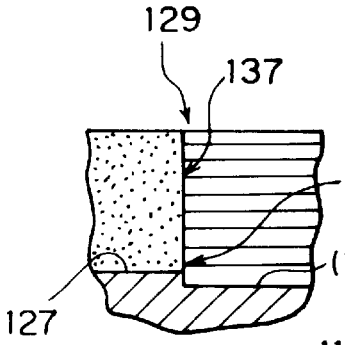
FIG. 5A PRIOR ART
FIGS. 5A, 5B, and 5C are cross-sectional views taken on lines 5A—5A, 5B—5B, and 5C—5C of FIG. 4 respectively.

Referring to FIG. 5A, a circumference surface 127 and the base plate surface 117 form stepwise construction with a vertical surface 131 at a spiral end point 129 of the inner wall.

Figure 5B:
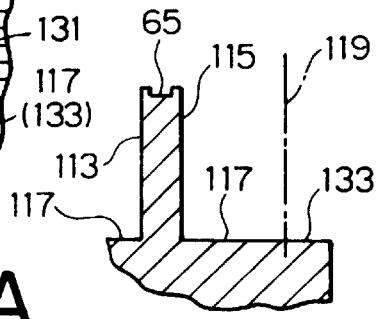
FIG. 5B PRIOR ART

Referring to FIG. 5B, a base plate surface is partitioned by the virtual involute curve 119 into an outside base plate surface 133 and the inside base plate surface 117, both of which are formed in the same height.

Figure 5C:
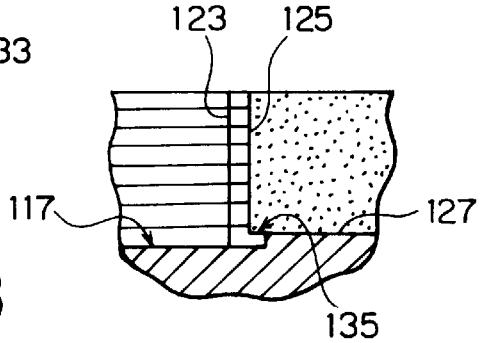
FIG. 5C PRIOR ART

Referring to FIG. 5C, the inside base plate surface 117 and the circumference surface 127 form stepwise construction with the vertical surface 135 that is the outer end of the machined base plate. There is a spiral end of the spiral outer wall at the fixed point 123. The spiral outer wall is machined until the fixed point 125.

As shown in FIG. 4, a surface 133 is positioned outside the virtual involute curve which is the extension line of the inner wall surface of the spiral element. Furthermore the surface is the same as the inside base plate surface 117, and is equal to the surface 127 with a machining stock. In addition, burrs arise in the vertical surface 135 and vertical surface 131, which are boundaries between the surface 133 and surface 127, when the base plate surface 117 and the surface 133 are machined. Furthermore, burrs arise on a boundary between the surface 133 or surface 117 and the circumference of the base plate when the surfaces 117 and 133 are machined. Moreover, a vertical surface 137 is vertical to the surfaces 117 and 133, and is given rough finishing or semi-finishing, and finishing with end mill machining.

Now description will be made as regards the preferred embodiments of the present invention with reference to drawings.

A scroll type of fluid machinery according to embodiments of the present invention has construction similar to that of the conventional scroll type of fluid machinery shown in FIG. 1. However, the scroll type of fluid machinery according to embodiments of the present invention has different construction of a fixed scroll member and a movable scroll member. In the following description, similar numerals are assigned to parts similar to parts used in prior art.

Figure 6:
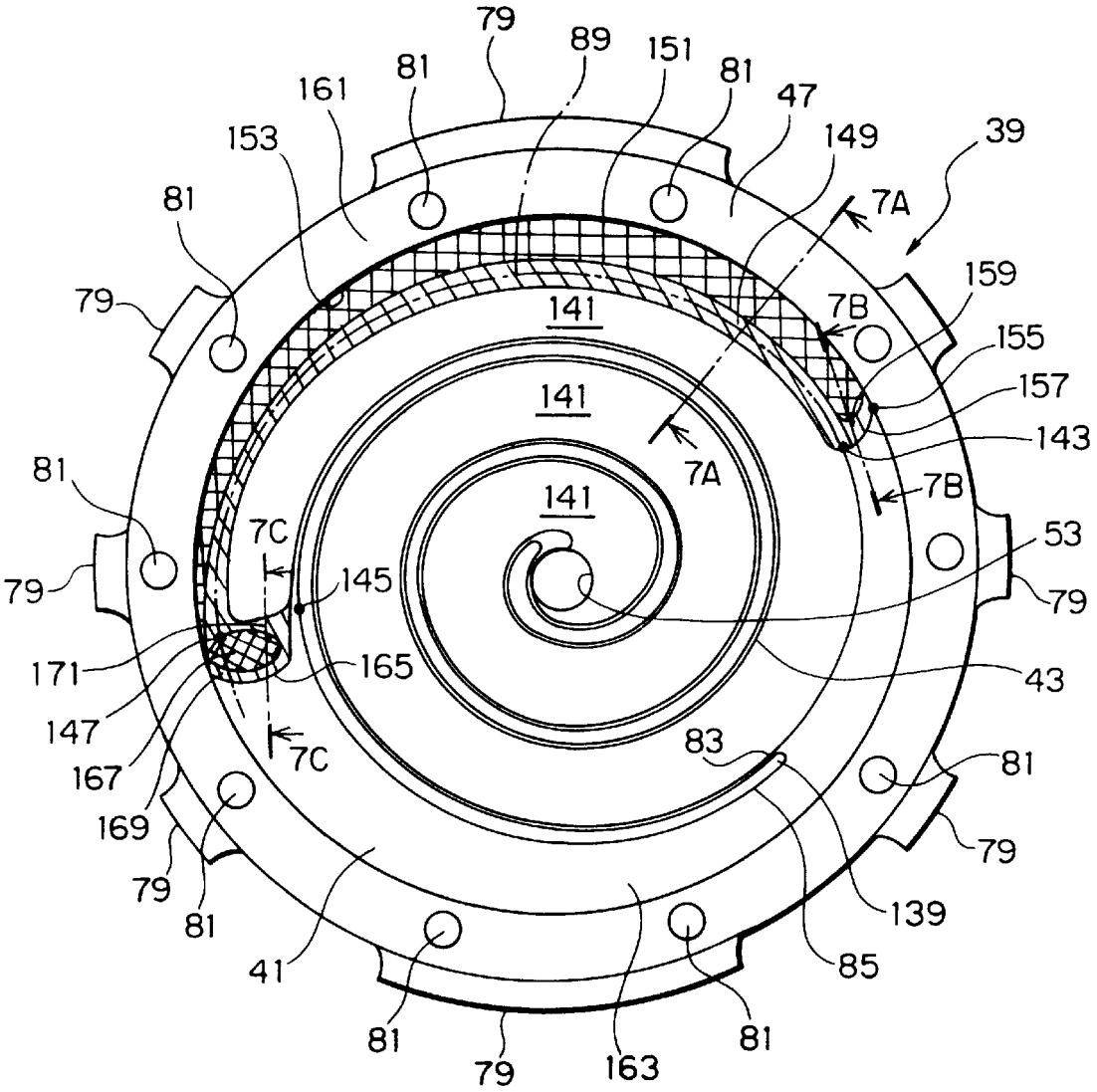
FIG. 6 is a front view showing a fixed scroll member as a scroll member according to a first embodiment of the present invention.

Referring to FIG. 6, a fixed scroll member is shown as a scroll member according to a first embodiment of the present invention. In this example, a hatched area shows a slant face in a bare surface, that is, a slant face, such as casting surface keeping the state of being molded. In addition, a meshed area shows an area that is lower than the base plate surface and is a surface with a bare surface.

As shown in FIG. 6, the fixed scroll member 39 comprises a base plate 41 and the spiral element 43 projecting from the base plate surface. A fixed section 47 is provided for fixing the base plate 41 to the casing 21 around the base plate 41. The fixed section 47 is formed with projecting in this side more than the base plate 41. In addition, a projecting piece 79 for fixing is formed around the fixed section 47. Furthermore, the fixed section 47 comprises the plurality of through holes 81 that become paths of fluid or lubricant. In the center of the spiral element 43, the discharge opening 53 is provided for discharging compressed fluid. The spiral element 43 constructs the spiral wall that is a projecting belt defined by the inner wall surface 83 and the outer wall surface 85 so that the spiral element 43 may draw an involute curve with this discharge opening 53 as the center. In the upper end surface of this spiral wall, a tip seal groove 139 is formed. A base plate surface 141 is extended to a fixed point 143 that is a midway point of the virtual involute curve 89 that is an extension line of the involute curve drawn by the spiral inner wall surface 83. Further, the base plate surface 141 is formed to a fixed point 145, an end of the outer wall 85, that is a midway point of the involute curve drawn by the spiral outer wall surface 85. A slant face 149 faces toward the outside along the virtual involute curve 89 counterclockwise in the figure and is formed from the fixed point 143 to a fixed point 147. An area around the virtual involute curve 89 is an area forming an intake pocket section with the counterpart of scroll member not shown. An area is provided near to the center from the virtual involute curve 89 of this slant face 149 and has a width narrower than the wall thickness of the counterpart of scroll member.

Figure 7A:
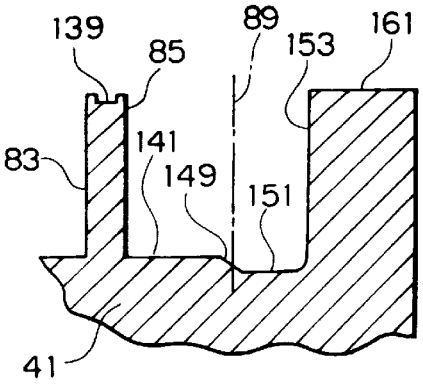
FIGS. 7A, 7B, and 7C are cross-sectional views taken on lines 7A—7A, 7B—7B, and 7C—7C of FIG. 6 respectively.

As shown in FIG. 7A, a horizontal surface 151 is formed among the base plate surface 141, the outside of the slant face 149 as a chamfered section, and the fixed section 47. This horizontal surface 151 is extended to a vertical surface 153 that constructs an inner circumference surface of the fixed section 47.

Figure 7B:
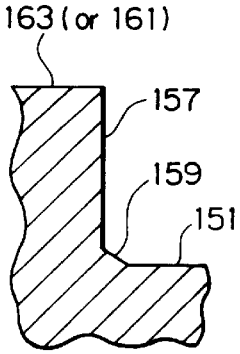

As shown in FIG. 7B, a vertical surface 157 is formed from the fixed point 143 to the fixed point 155. A slant face 159 is formed between this vertical surface 157 and the horizontal surface 151.

Figure 7C:
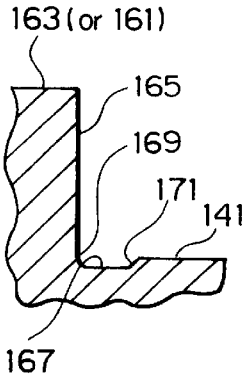

In addition, as shown in FIG. 7C, a vertical surface 165 is formed at an end of a horizontal surface 163 whose height is the same as that of a surface 161 of the fixed section. Further, a surface 167 is formed between the base plate surface 141 and the vertical surface 165 as a concave section, such as a pit and a hollow, that is more concave than the base plate surface 141. This surface 167 communicates with the base plate surface 141 and the vertical surface 165 via slant faces 169 and 171, respectively.

For producing the above-mentioned scroll member 39, material of a scroll member is casted into the shape shown in FIG. 6. With starting from the center, the material is machined with an end mill and the like on the outer wall surface 85, the inner wall surface 83, and the base plate surface 141, in turn. In that time, specified surfaces remain being formed in bare surfaces, that is, with keeping surfaces just after casting or molding even after machining. The specified surfaces contains the slant faces 149 and 159, the vertical surfaces 153, 157, and 165, and the surfaces 151 and 167. Therefore, the slant face 149 corresponds to the circumference surface of the base plate surface and prevents burrs from arising at the time of machining the outer wall surface 85 and the base plate surface 141 of the spiral element 43 simultaneously. In addition, the slant face 159 is on an extension line of the slant face 149, and prevents burrs from arising in the base plate surface 141 at the time of machining the inner wall surface 83 and the base plate surface 141 of the spiral element 43 simultaneously.

Furthermore, a line is defined by an intersection between the base plate surface 141 and the slant face 149. The line also leans to the center side more than an extension line of the inner wall surface 83 of the spiral element 43. However, the distance (gap) is formed between the line of intersection and the extension line of the inner wall surface 83 of the spiral element 43 to be smaller than the thickness of the wall of the spiral element 43. Further, a slant face 171 is formed at an end of extension of the base plate surface so as to prevent burrs from arising from the base plate surface 141 at the time of machining spiral end section 145's outer wall of the spiral element 43's outer wall surface 85 and the base plate surface 141 simultaneously. In this manner, a chamfered section is formed so that relationships, (pitch between spiral walls−thickness of wall*2)<width of base plate after spiral end<(pitch between spiral walls−thickness of wall) may hold. Since the spiral wall surface and the circumference surface of the base plate are chamfered, it is possible to suppress occurrence of burrs by machining using an end mill whose diameter is larger than the width of the base plate 41 after the spiral end 143 of the inner wall of the spiral element 43.

In addition, it is possible to keep the vertical surface 165 in a bare surface by keeping the concave surface 167, such as bottom surfaces of pit and hollow, in a bare surface. In the same time, the angle become acute between the outer wall and the movement direction of the end mill so that it is possible to prevent burrs of the wall surface from arising. Here, occurrence of burrs also depends on materials and sharpness of an end mill. However, it is possible to prevent occurrence of burrs by making the contact angle between a machined surface and an end face a dull angle that exceeds 90° as many as possible, that is, making acute an angle of chamfer of a bare surface. In this manner, it is possible to prevent occurrence of burrs at the time of machining start or a tool passing through when machining is completed.

Here, an intake pocket is an area that is positioned outside the virtual involute curve that is an extension line of the inner wall surface of the spiral element shown by an alternate long and short dash line in FIG. 6. The intake pocket becomes a gas passageway for supplying intake gas from both outer ends of spirals to a scroll chamber of a compressor. Owing to this, a narrow gas passageway would make loss of inlet pressure arise, and hence, decrease in efficiency.

According to the first embodiment of the present invention, the gas passageway is, however, expanded by making a bottom surface of the intake pocket section lowered by a step in comparison with a spiral bottom surface forming the scroll chamber. In addition, it is possible to smoothly suck the gas by chamfering the spiral base plate surface that corresponds to an entrance of the scroll chamber. Furthermore, high dimensional accuracy is not necessary for the intake pocket section because the intake pocket section is the gas passageway. Owing to this, the intake pocket section can be formed in a bare surface. As the first embodiment of the present invention, it is possible to suppress and prevent burrs arising on boundaries between machined surfaces and surfaces kept in bare surfaces by making the bottom surface of the intake pocket section lowered more than the bottom surface of the scroll chamber and forming the chamfer between them with the slant face 149 or slant faces 171 and 159 and the like.

Figure 8:
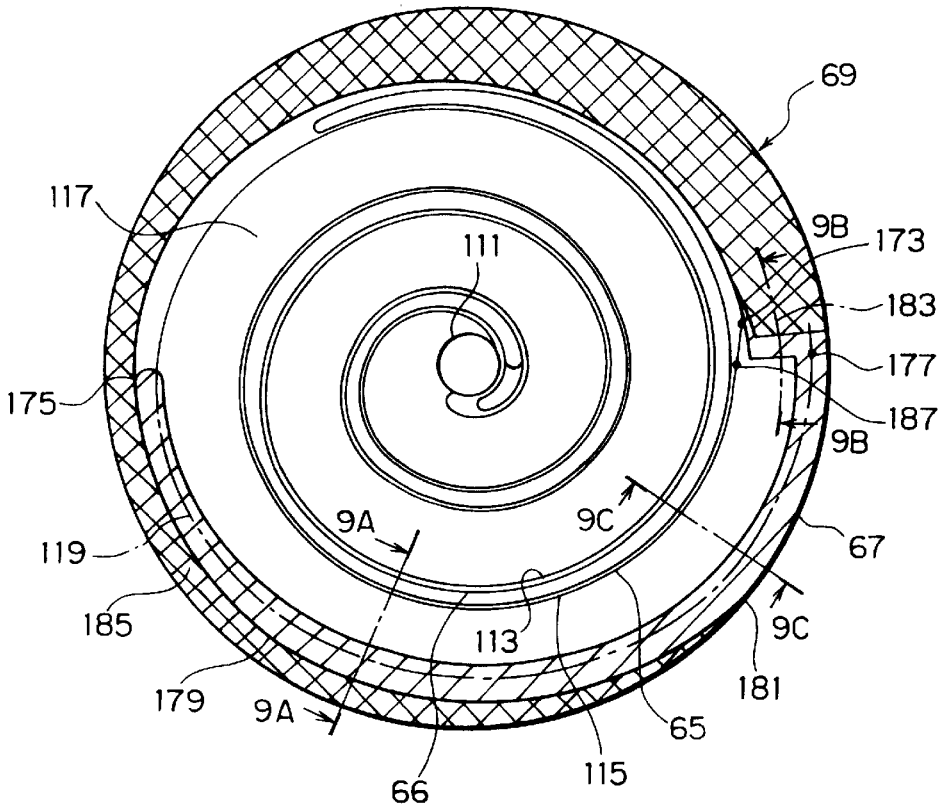
FIG. 8 is a front view showing a movable scroll member as a scroll member according to a second embodiment of the present invention.

Referring to FIG. 8, a movable scroll member is shown as a scroll member according to a second embodiment of the present invention. In this example, oblique lines show slant faces similar to those in FIG. 6 and meshed lines show surfaces lower than the base plate surface. Furthermore in FIG. 9, a machined surface is shown by horizontal parallel lines, and casting surface is shown by a dotted surface which is kept in a bare surface.

As shown in FIG. 8, the movable scroll member 69 comprises the base plate 67, and the spiral element 65 projecting from a base plate surface. The spiral element 65 constructs a spiral wall that is a projecting belt defined by the inner wall surface 113 and the outer wall surface 115 so that an involute curve may be drawn from the center. In the upper end surface of the spiral wall, a tip seal groove 66 is formed. A base plate surface 117 is formed to a fixed point 177 that is near by a virtual involute curve 119 that is an extension line of the involute curve drawn by the inner wall surface 113. Further, the base plate surface 117 is also formed to the vicinity of a point 173 that is a midway point of the involute curve drawn by the outer wall surface 115. A slant face 179 is formed as a chamfered section from a fixed point 175 to a fixed point 177 (ends of the wall section of the spiral element), which are midway points of the virtual involute curve drawn by the inner wall surface 113.

Figure 9B:
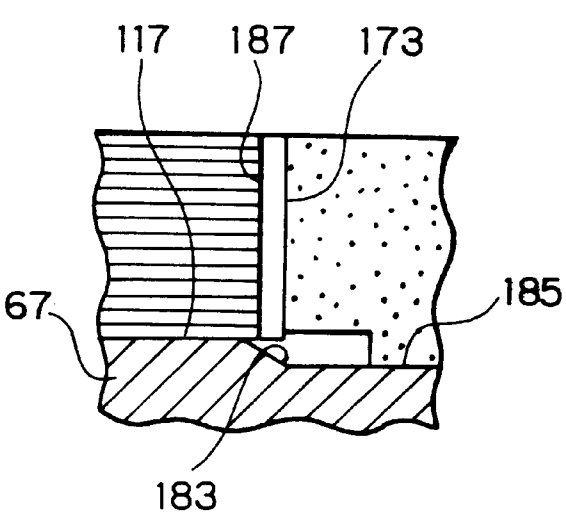
FIGS. 9A, 9B, and 9C are cross-sectional views taken on lines 9A—9A, 9B—9B, and 9C—9C of FIG. 8 respectively.
Figure 9A:
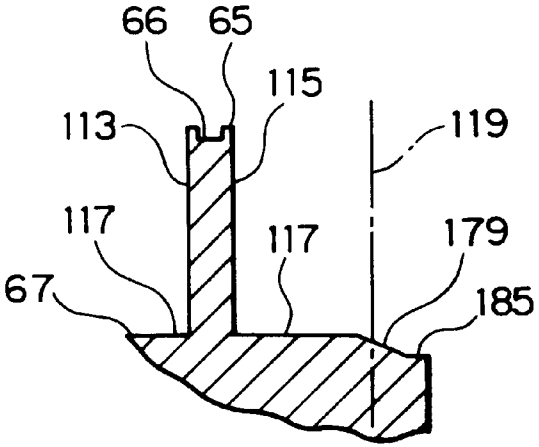

As shown in FIG. 9A, a surface 185 is formed from the end of the base plate surface 117 to a fixed point 181 outside the spiral element 65, and outside of the base plate surface 117 and the slant face 179 in a circumference. The surface 185 is lower than the base plate surface 117 and is kept in a bare surface.

As shown in FIG. 9B, the surface 185 is connected to the base plate surface 117 via a slant face 183. Machining is given to an area through the spiral end of the outer wall surface of the spiral element 65, that is, the outer end 187 of the involute outer wall surface to the outer end 173 of the machined spiral outer wall, as described later. As shown in the right side of the figure, the area is outside the machined area and remains being formed in a bare surface, that is, in a surface just after casting or molding.

Figure 9C:
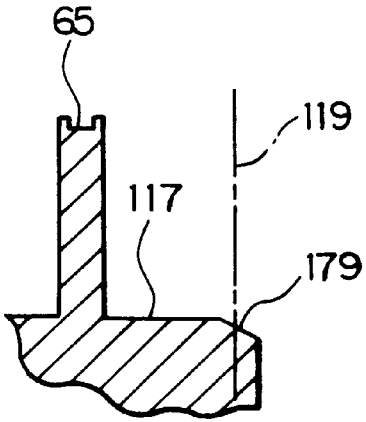

As shown in FIG. 9C, a slant face 179 is formed outside the base plate surface 117. Since such bare faces are left on slant faces 179 and 183, and the vertical surface of the end 175 of the spiral element, reduction is performed in conventional machining to the circumference of base plate surface, that is, machining of a surface 127 (FIG. 4), and finishing of an end face 175 at the end of the base plate. Here, the slant face 179 is the circumference surface of the base plate and prevents burrs from arising in the circumference of the base plate when the spiral outer wall and the base plate are machined simultaneously.

In addition, the slant face 183 can prevent burrs from arising in the base plate (135 in prior art) of the outer wall surface's end of the spiral element. Furthermore, burrs do not arise also in the base plate (131 in prior art) of the inner wall surface's end of the spiral element by eliminating machining of the surface 185 (reference numeral 133 in FIG. 3).

Moreover, a line is defined by intersection between the base plate surface 117 and the slant face 179. The line leans to the center side more than the involute curve 119 that is an extension line of the inner wall surface of the spiral element. However, the deviated amount is smaller than the wall thickness of the spiral element constructing the counterpart of scroll member. In this event, a base plate can be formed between the spiral end 183 of the outer wall and the spiral end 175 of the inner wall only by performing machining of the base plate simultaneously when the outer wall between them is machined.

Therefore, in the second embodiment of the present invention, a chamfered section is formed so that relationships, (pitch between spiral walls−thickness of wall*2)<width of base plate after spiral end<(pitch between spiral walls−thickness of wall) may hold.

Further, chamfers are made on the spiral wall surface and the circumference surface of the base plate so that it is possible to suppress occurrence of burrs by machining using an end mill whose diameter is larger than the width of the base plate after the spiral end of the inner wall.

In addition, an intake pocket is an area that is positioned outside the virtual involute curve 119 that is an extension line of the inner wall surface of the spiral element shown by an alternate long and short dash line in the figure. The intake pocket becomes a gas passageway for supplying intake gas from both outer ends of spirals to a scroll chamber of a compressor. Owing to this, a narrow gas passageway would make loss of inlet pressure arise, and hence, decrease in efficiency.

According to the second embodiment of the present invention, the gas passageway can, however, be expanded by making a bottom surface of the intake pocket section lowered by a step in comparison with a spiral base plate surface forming the scroll chamber. In addition, it is possible to smoothly suck the gas by chamfering the spiral base plate surface that corresponds to an entrance of the scroll chamber. Furthermore, high dimensional accuracy of the intake pocket section is not necessary because the intake pocket section is the gas passageway. Owing to this, the intake pocket section can be formed in a bare surface. Still more in the present invention, it is possible to suppress and prevent burrs arising on boundaries between machined surfaces and surfaces kept in bare surfaces by making the bottom surface of the intake pocket section, such as 185, lowered more than the bottom surface of the scroll chamber, such as 117, and forming the chamber, such as 179.

Figure 10:
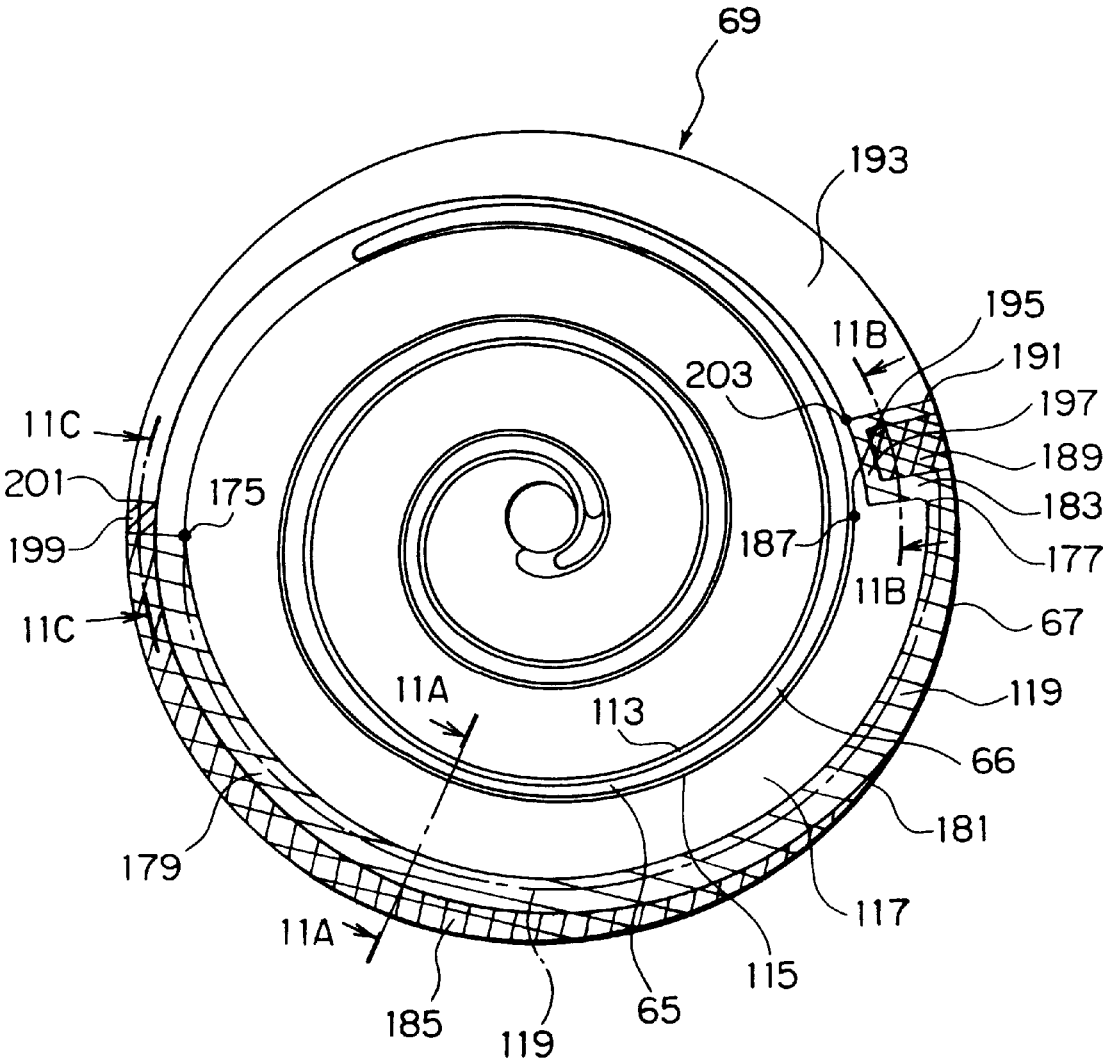
FIG. 10 is a front view showing a movable scroll member as a scroll member according to a third embodiment of the present invention.

Referring to FIG. 10, a movable scroll member is shown as a scroll member according to a third embodiment of the present invention. In FIG. 10, the movable scroll member 69 comprises the base plate 67, and the spiral element 65 projecting from a base plate surface 117. The spiral element 65 constructs a spiral wall that is a projecting belt defined by the inner wall surface 113 and the outer wall surface 115 so that an involute curve may be drawn from the center. In the upper end surface of the spiral wall, a tip seal groove 66 is formed. A base plate surface 117 is formed to a fixed point 175 that is near by the virtual involute curve 119 that is an extension line of the involute curve drawn by the inner wall surface 113. Further, the base plate surface 117 is also formed to the vicinity of a point 187 that is a midway point of the involute curve drawn by the outer wall surface 115. A slant face 179 is a chamfered section formed from a fixed point 175 to a fixed point 177 (ends of the spiral wall), which are midway points of the virtual involute curve drawn by the inner wall surface 113. An intake pocket section is formed by the virtual involute curve shown by an alternate long and short dash line with the counterpart of scroll member.

Figure 11C:
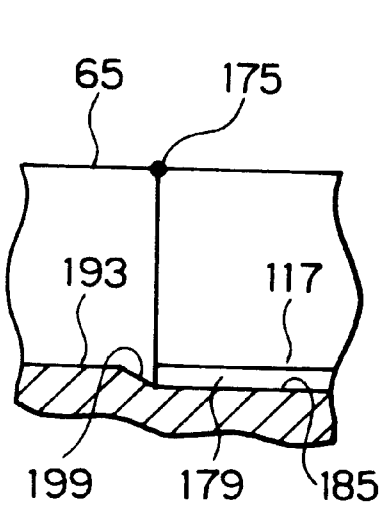
FIGS. 11A, 11B, and 11C are cross-sectional views taken on lines 11A—11A, 11B—11B, and 11C—11C of FIG. 10 respectively.
Figure 11B:
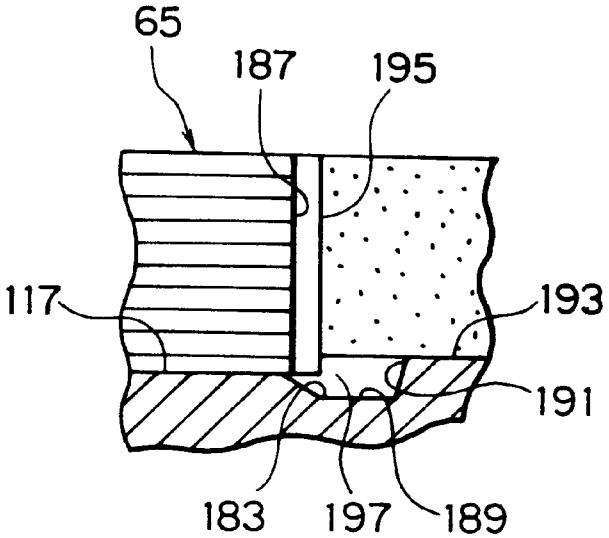
Figure 11A:
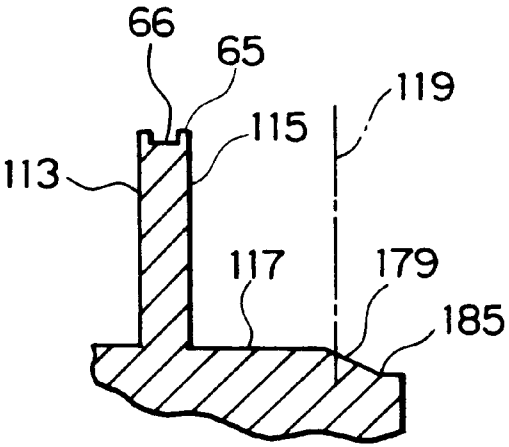

Referring to FIG. 11A, a surface 185 is formed from the end 175 of the base plate surface 117, the out side of the spiral element 65, and the outside of the base plate surface 117 and the slant face 179 to a fixed point 181 in a circumference, the surface 185 which is lower than the base plate surface 117.

As shown in FIG. 11B with moving counterclockwise in FIG. 10, the surface 189 that is lower than the base plate surface 117 is connected to the base plate surface 117 via a slant face 183. Furthermore, a surface 193 is formed higher than the base plate surface 117 and is connected to the surface 189 via a slant face 191. Machining is given to an area through the spiral end of the outer wall surface of the spiral element 65, that is, the outer end 187 of the involute outer wall surface to the outer end 195 of the machined spiral outer wall, as described later. The area is left in a bare surface, that is, in a surface just after molding, outside the machined area that is, the area is shown in the right side in FIG. 11B. In addition, an outer wall surface is formed including the outer end 195 of the machined spiral outer wall and a slant face 197 leading to the surface 189. In consequence, the surface 189 is approximately square, its three sides are surrounded by slant faces 183, 197, and 191, and the other side is a peripheral surface of the base plate 67.

As shown in FIG. 11C, the end 175 of the spiral element 65 is a vertical surface. Outside this spiral element 65, a surface 185 is connected to the surface 193 via a slant face 199.

Here, casting surfaces are left on slant faces 179, 183, 197, 191, and 199, surfaces 185, 189, and 193, and the vertical surface of the end 175 of the spiral element 65, all of which are kept in bare surfaces just after molding. In addition, the slant face 179 is a chamfered section to prevent burrs from arising in the circumference of the base plate. In addition, the slant face 183 also prevents burrs from arising in the base plate of the outer wall surface's end. Furthermore, burrs do not arise also in the base plate 117 (131 in prior art) of the end of the inner wall surface 175 by eliminating machining of the surface 185.

Furthermore, a line is defined by intersection between the base plate surface 117 and the slant face 179. The line leans to the center side more than the involute curve 119 that is an extension line of the inner wall of the spiral element. However, the deviated amount is smaller than the wall thickness of the spiral element constructing the counterpart of scroll member.

In this event, a base plate surface can be formed between the fixed point 195 of the end of the outer wall surface and the fixed point 175 of the end of the inner wall only by performing machining of the base plate simultaneously when the outer wall is machined.

Therefore, a chamfered section is formed in the third embodiment of the present invention so that relationships, (pitch between spiral walls−thickness of wall*2)<width of base plate after spiral end<(pitch between spiral walls−thickness of wall) may hold. Further, chamfers are formed on the spiral wall surface and the circumference surface of the base plate so that it is possible to suppress occurrence of burrs by machining using an end mill whose diameter is larger than the width of the base plate after the spiral end of the inner wall.

In addition, occurrence of burrs also depends on materials and sharpness of an end mill. However, it is possible to prevent occurrence of burrs by making the contact angle between a machined surface and an end face a dull angle that exceeds 90° as many as possible, that is, making an angle of chamfer acute. Furthermore, it is possible to prevent occurrence of burrs at the time of machining start or a tool passing through when machining is completed by providing a concavity, for example, 189 in the spiral end of the outer wall of the spiral element.

Here, an area is positioned outside the virtual involute curve 119 that is an extension line of the inner wall surface of the spiral element shown by an alternate long and short dash line in FIG. 10. The area is an intake pocket that becomes a gas passageway for supplying intake gas from both outer ends of spirals to a scroll chamber of a compressor. Owing to this, a narrow gas passageway would make loss of inlet pressure arise, and hence, decrease in efficiency.

According to the third embodiment of the present invention, the gas passageway is, however, expanded by making a bottom surface of the intake pocket section lowered by a step in comparison with a spiral base plate surface forming the scroll chamber. In addition, it is possible to smoothly suck the gas by forming a chamfered section, for example, surface 179 in the spiral base plate surface that corresponds to an entrance of the scroll chamber. Furthermore, high dimensional accuracy is not necessary for the intake pocket section because the intake pocket section is the gas passageway. Owing to this, the intake pocket section can be formed in a bare surface. As the present invention, it is possible to suppress and prevent burrs arising on boundaries between machined surfaces and surfaces kept in bare surfaces by making the bottom surface of the intake pocket section lowered more than the bottom surface of the scroll chamber and forming the chamfer between them.

Figure 12:
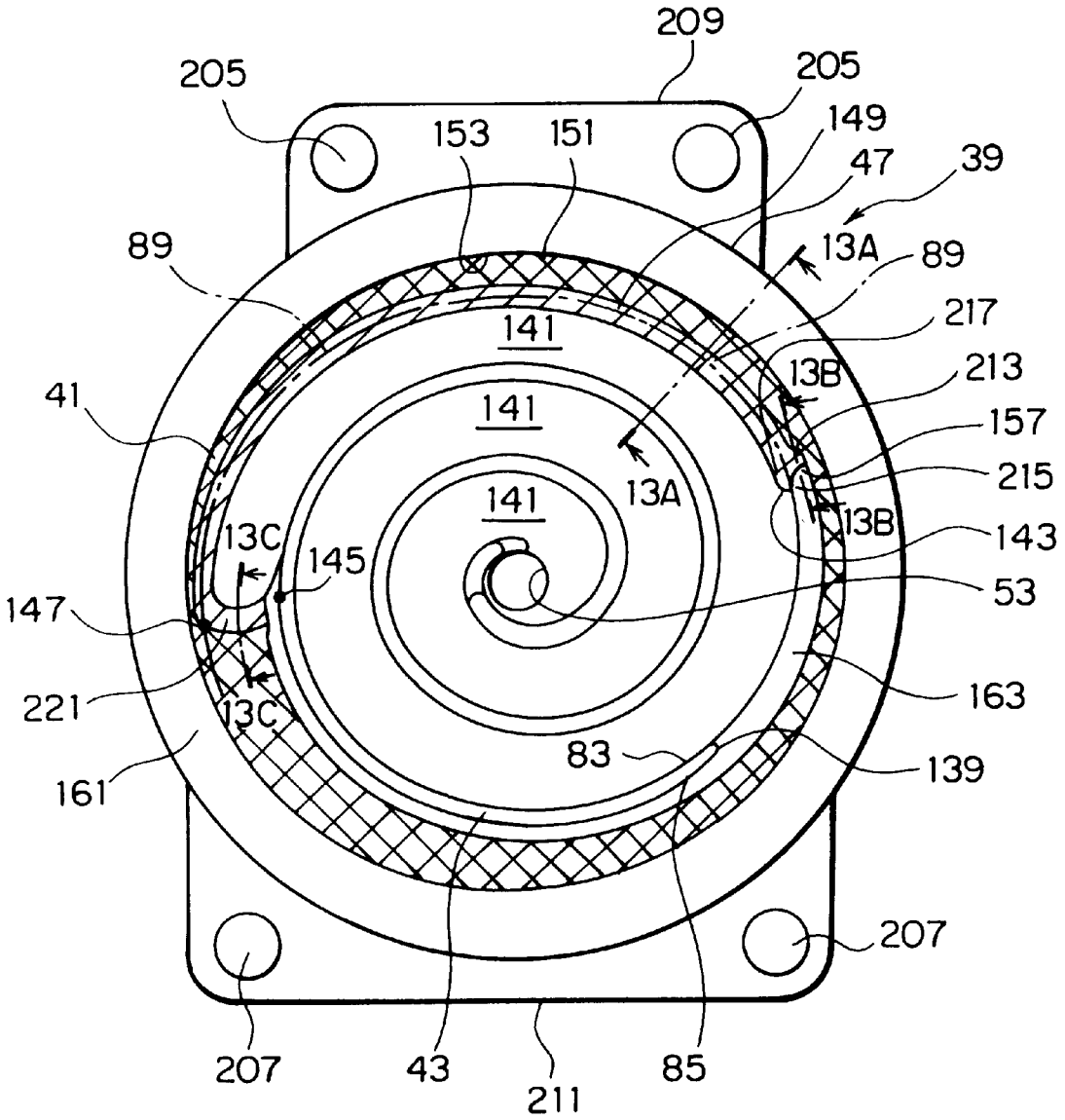
FIG. 12 is a front view showing a fixed scroll member as a scroll member according to a fourth embodiment of the present invention.

Referring to FIG. 12, a fixed scroll member is shown as a scroll member according to a fourth embodiment of the present invention. In this example, a hatched area shows a slant face in a bare surface, that is, a slant face keeping the state of being molded. In addition, a meshed area shows an area that is lower than the base plate surface and is a surface in a bare surface.

As shown in FIG. 12, the fixed scroll member 39 is different from the example in FIG. 6, and is formed with a casing in one piece. The fixed scroll member 39 comprises a base plate 41 and the spiral element 43 projecting from the base plate surface. A fixed section 47 is formed with the casing 21 in one piece and is provided around the base plate 41. In FIG. 12, the fixed section 47 is formed with projecting in this side more than the base plate 41. Mounting pieces 209 and 211 are formed around the fixed section 47, respectively. The mounting pieces 209 and 211 provide mounting holes 205 and 207 for mounting to a vehicle respectively. In the center of the spiral element 43, the discharge opening 53 is provided for discharging compressed fluid. The spiral element 43 constructs the spiral wall that is a projecting belt defined by the inner wall surface 83 and the outer wall surface 85 so that the spiral element 43 may draw an involute curve with this discharge opening 53 as the center. In the end surface of this spiral wall, a tip seal groove 139 is formed. A base plate surface 141 is extended to a fixed point 143 that is a terminal point of the virtual involute curve that is drawn by the spiral inner wall surface 83. In this section, the spiral wall is ended. Further, the base plate surface 141 is formed with extending to a fixed point 145 (an end of the outer wall surface) that is a midway point of the involute curve drawn by the spiral outer wall surface 85. A slant face 149 is formed from the fixed point 143 to a fixed point 147. The slant face 149 is a chamfered section facing toward the outside along the virtual involute curve 89 that is an involute curve that is an extension line of an involute curve drawn by the spiral inner wall surface 83. A horizontal surface 151 is lower by the slant face 149 than the base plate surface 141 and is in a bare surface. Furthermore, the horizontal surface is formed among the periphery of the slant face 149, the periphery of the spiral wall, and the fixed section 47.

An intake pocket section is formed by the virtual involute curve 89 with the counterpart of scroll member. An area is provided near to the center from the virtual involute curve 89 of this slant face 149 and has a width narrower than the wall thickness of the counterpart of scroll member.

Figure 13A:
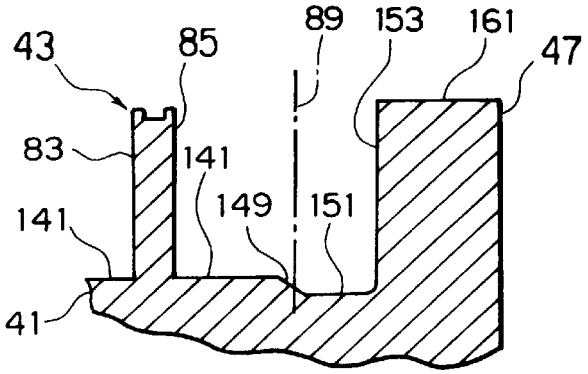
FIGS. 13A, 13B, and 13C are cross-sectional views taken on lines 13A—13A, 13B—13B, and 13C—13C of FIG. 12 respectively.

As shown in FIG. 13A, a horizontal surface 151 is formed among the base plate surface 141, the outside of the slant face 149, and the fixed section 47. This horizontal surface 151 is extended to the vertical surface 153 that is an inner circumference surface of the fixed section 47.

Figure 13B:
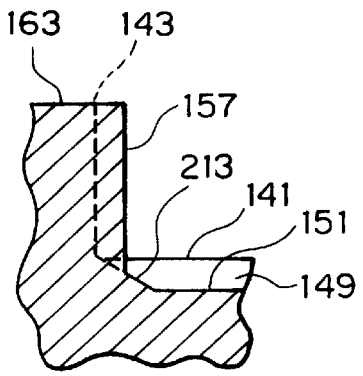

As shown in FIG. 13B, a vertical surface 157 is formed at the fixed point 143 in the end face of the spiral end of the inner wall. A slant face 213 is formed between this vertical surface 157 and the horizontal surface 151.

Figure 13C:
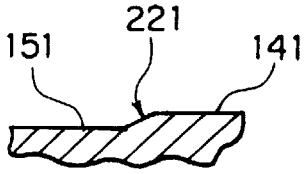

As shown in FIG. 13C, a slant face 221 is formed between the base plate surface 141 and the horizontal surface 151.

Figure 13E:
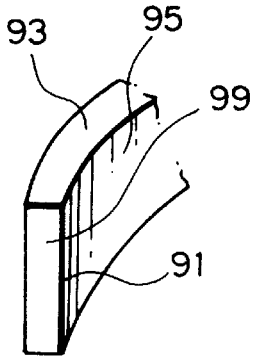
FIG. 13E PRIOR ART
FIG. 13E is a perspective view showing a part similar to that in FIG. 13D on the basis of prior art for the sake of comparison.
Figure 13D:
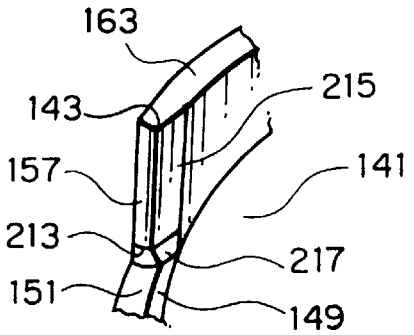
FIG. 13D is a perspective view of a part shown in FIG. 13B.

As shown in FIG. 13D, a vertical surface 215 is a chamfered section and is formed in the inner corner surface of the spiral inner wall's spiral end. A slant face 217 is formed between a base section of the vertical surface 215 and the slant face 149. Furthermore, a slant face 219 is also formed between the vertical surface 157 and the horizontal surface 151.

As shown in FIG. 13E, burrs conventionally arise in an inner corner section 91 of the inner wall's spiral end by a working tool passing through the section for machining. However, the chamfered section (the vertical surface 215) is provided in the corner in a bare surface as shown in FIG. 13D so that it is possible to prevent occurrence of burrs due to a tool at the time of machining. Further, a tool is, conventionally, contacted to the inner wall surface when the spiral end of the inner wall is machined. Hence, the inner wall is elastically transformed by machining load, and therefore, the higher the height of the inner wall becomes, the wider the width of the inner wall becomes by machining. Hence, perpendicularity becomes worse, and in consequence, the inner wall is easily deformed accidentally. However, this vertical surface 215 is provided as shown in FIG. 13D such that the inner wall is little deformed, and, therefore, it is possible to increase the perpendicularity to the base plate surface of the inner wall's spiral end.

In order to produce the above-mentioned scroll member, a raw scroll member is molded to have a shape shown in FIG. 12. After that, a machine work is performed by an end mill and the like of the outer wall surface 85, the inner wall surface 83, and the base plate with starting from the center. In that time, the slant face 221 prevents burrs in the base plate when the outer wall and base plate surface of the spiral end of the spiral element's outer wall are simultaneously machined. Therefore, the horizontal surface 151 can be provided in a bare surface. In addition, casting surfaces remains which are slant faces 149 and 213, horizontal surface 151, and vertical surfaces 153 and 157 and are kept in bare surfaces. On the virtual involute curve 89, the slant face 149 prevents burrs in the base plate surface when the outer wall and base plate 41 of the spiral are simultaneously machined. Furthermore, the slant face 217 is on an extension line of the slant face 149, and prevents occurrence of burrs from the base plate surface when the inner wall surface and base plate of the spiral are machined simultaneously. Further, a line is defined by intersection between the base plate surface 141 and the slant face 149. The line leans to the center side more than an extension line of the spiral inner wall. However, the distance (gap) is formed between the line of intersection and the extension line of the spiral inner wall so as to be smaller than the thickness of the spiral's wall.

In this manner, a chamfered section is formed so that relationships, (pitch between spiral walls−thickness of wall*2)<width of base plate after spiral end<(pitch between spiral walls−thickness of wall) may hold. In addition, a chamfer is formed in the spiral's wall surface and the circumference of the base plate. By these chamfers, it is possible to suppress occurrence of burrs by machining using an end mill whose diameter is larger than the width of the base plate after the spiral end of the spiral element's inner wall.

In addition, the gas passageway is expanded by making a bottom surface of the intake pocket section lowered by a step in comparison with a spiral base plate surface forming the scroll chamber according to the fourth embodiment of the present invention similarly to the first embodiment. In addition, it is possible to smoothly suck the gas by forming a chamfer in the spiral base plate surface that corresponds to an entrance of the scroll chamber. Furthermore, high dimensional accuracy is not necessary for the intake pocket section because the intake pocket section is the gas passageway. Owing to this, the intake pocket section can be formed in a bare surface. As the fourth embodiment of the present invention, it is possible to suppress and prevent burrs arising on boundaries between machined surfaces and surfaces kept in bare surfaces by making the bottom surface of the intake pocket section lowered more than the bottom surface of the scroll chamber and forming the chamfer between them.

Figure 14:
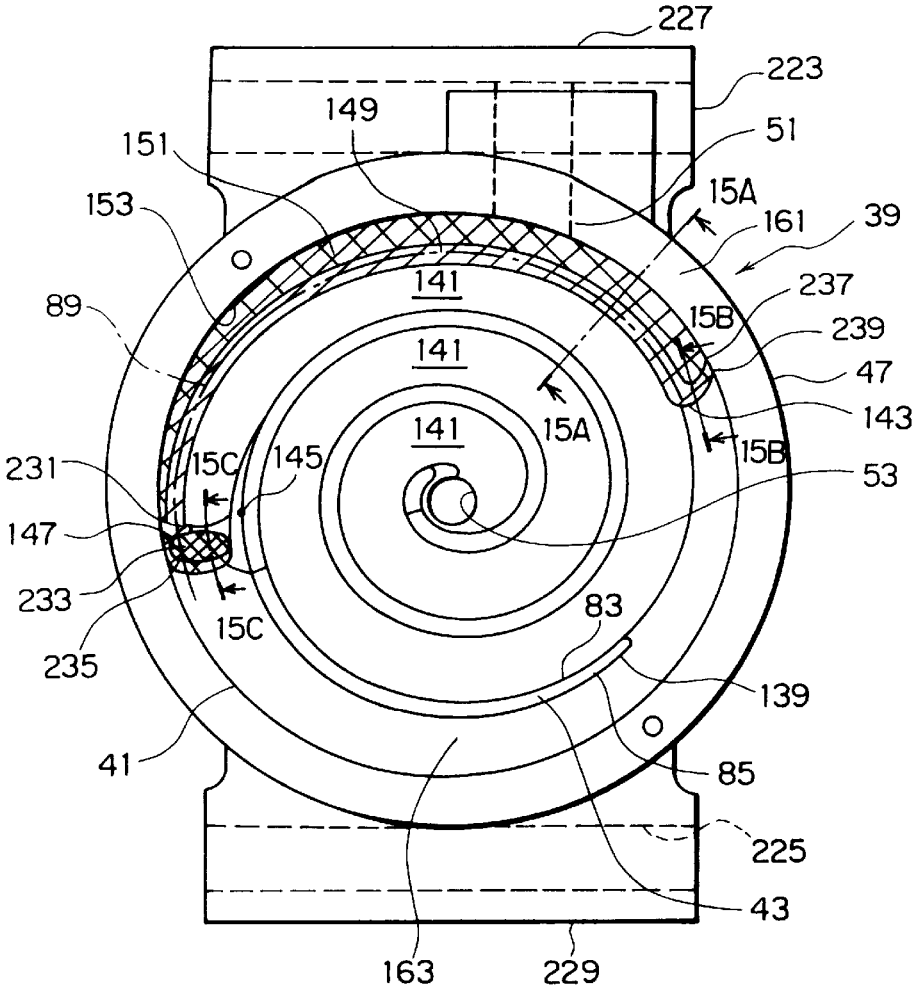
FIG. 14 is a front view showing a fixed scroll member as a scroll member according to a fifth embodiment of the present invention.

Referring to FIG. 14, a fixed scroll member is shown as a scroll member according to a fifth embodiment of the present invention. In this example, a hatched area shows a slant face in a bare surface, that is, a slant face keeping the state of being molded. In addition, a meshed area shows an area that is lower than the base plate surface and is a surface in a bare surface.

As shown in FIG. 14, the fixed scroll member 39 is formed with a casing in one piece, similarly to the example in FIG. 12. The fixed scroll member 39 comprises a base plate 41 and the spiral element 43 projecting from the base plate surface. As regards the fixed scroll member 39, a fixed section 47 is formed with the casing 21 in one piece and is provided around the base plate 41. In FIG. 14, the fixed section 47 is formed with projecting in this side more than the base plate 41. Mounting pieces 227 and 229 are formed around the fixed section 47, respectively. The mounting pieces 227 and 229 provide mounting holes 223 and 225 for mounting to a vehicle, respectively. In addition, the intake port 51 is provided to the base plate surface 41 with radially passing through the fixed section 47. In the center of the spiral element 43, the discharge opening 53 is provided for discharging compressed fluid. The spiral element 43 constructs the spiral wall that is a projecting belt defined by the inner wall surface 83 and the outer wall surface 85 so that the spiral element 43 may draw an involute curve with this discharge opening 53 as the center. In the upper end surface of this spiral wall, a tip seal groove 139 is formed. An involute curve is drawn by the spiral inner wall surface 83. The involute curve is extended to the fixed point 143, forming the virtual involute curve 89. In this section, the spiral inner wall surface is ended. Further, an involute curve is drawn by the spiral outer wall surface 85. The involute curve is formed to the midway fixed point 145 (the end of the outer wall surface). A base plate surface 141 is formed from the fixed point 143 to the fixed point 147 along the virtual involute curve 89 that is an involute curve that is an extension line of an involute curve drawn by the spiral inner wall surface 83. Further, a slant face 149 is formed outside the base plate surface 141. The slant face 149 is a chamfered section facing toward the outside of the radial direction. A horizontal surface 151 is lower by the slant face 149 than the base plate surface 141. The horizontal surface 151 is kept in a bare surface and is formed along the periphery of the slant face 149, the periphery of the spiral wall, and the fixed section 47. In addition, a surface 233 is concave, such as pit and hollow, via the slant face 149 is formed in the end section of the base plate surface 141, and communicates with a vertical surface 237 via a slant face 235.

An intake pocket section is formed by the virtual involute curve 153 with the counterpart of scroll member. An area is provided near to the center from the virtual involute curve 153 of this slant face and has a width narrower than the wall thickness of the counterpart of scroll member.

Figure 15A:
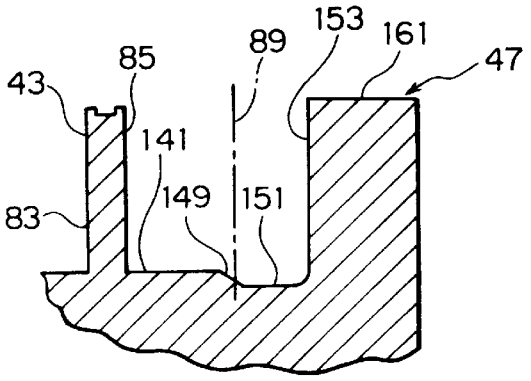
FIGS. 15A, 15B, and 15C are cross-sectional views taken on lines 15A—15A, 15B—15B, and 15C—15C of FIG. 14, respectively.

As shown in FIG. 15A, the base plate surface 141 is formed from the outer wall surface 85 of the spiral element. A horizontal surface 151 is formed between the outside of the slant face 149 that is a chamfered section, and the fixed section 47. This horizontal surface 151 is extended to the vertical surface 153 that is an inner circumference surface of the fixed section 47.

Figure 15B:
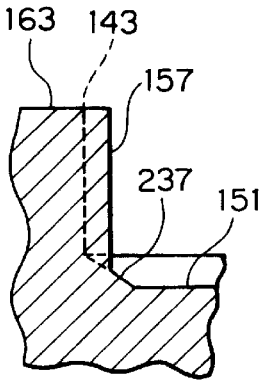

As shown in FIG. 15B, a vertical surface 157 is formed at the fixed point 143 in the end face of the spiral end of the inner wall in a horizontal surface 163 whose height is the same as that of a surface 161 of the fixed section. A slant face 237 is formed between this vertical surface 157 and the horizontal surface 151.

Figure 15C:
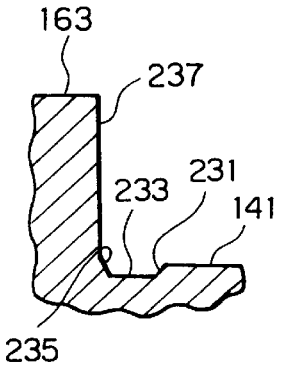

In addition, as shown in FIG. 15C, a slant face 231 is formed between the base plate surface 141 and the horizontal surface 233 that is concave, such as a pit and hollow. This horizontal surface 233 is connected to the vertical surface 237 formed in the end section of the horizontal surface 163 via the slant face 235.

In order to produce the above-mentioned scroll member, a raw scroll member is casted to have a shape shown in FIG. 14. After that a machine work is performed on the outer wall surface 85, inner wall surface 83, and base plate surface 141 are machined by an end mill and the like with starting from the center. In that time, the slant face 231 prevents burrs in the base plate when the outer wall surface 85 and base plate surface 141 of the spiral end of the spiral outer wall are simultaneously machined.

Therefore, the vertical surface 237 can be in a bare surface by providing the surface 233 in a bare surface, and in the same time, the angle between the outer wall surface and the moving direction of an end mill becomes acute, and hence, it is possible to prevent occurrence of burrs in the wall surface.

In addition, casting surface are formed on slant faces 149, 237 and 231, horizontal surface 151, and vertical surfaces 153, 157, and 237, all of which are kept in bare surfaces. The slant face 149 prevents burrs in the base plate surface 141 when the outer wall surface 85 and base plate surface 141 of the spiral are simultaneously machined. Furthermore, the slant face 237 is on an extension line of the slant face 149, and prevents occurrence of burrs from the base plate surface 141 when the inner wall surface 83 and base plate surface 141 of the spiral are simultaneously machined. Further, a line is defined by intersection between the base plate surface 141 and the slant face 149. The line leans to the center side more than an extension line of the spiral inner wall. However, the distance (gap)is formed between the line of intersection and the extension line of the spiral inner wall and is smaller than the thickness of the spiral's wall.

In this manner, a chamfered section is formed so that relationships, (pitch between spiral walls−thickness of wall*2)<width of base plate after spiral end<(pitch between spiral walls−thickness of wall) may hold. In addition, it is possible to suppress occurrence of burrs by machining using an end mill whose diameter is larger than the width of the base plate after the spiral end of the spiral element's inner wall by a chamfer being formed in the wall surface of the spiral and the circumference of the base plate.

According to the fifth embodiment of the present invention similarly to the first embodiment, the gas passageway is expanded by making a bottom surface of the intake pocket section lowered by a step in comparison with a spiral base plate surface forming the scroll chamber. In addition, it is possible to smoothly suck the gas by forming a chamfer in the spiral base plate surface that corresponds to an entrance of the scroll chamber. Furthermore, high dimensional accuracy is not necessary for the intake pocket section because the intake pocket section is the gas passageway. Owing to this, the intake pocket section can be formed in a bare surface. As the fifth embodiment of the present invention, it is possible to suppress and prevent burrs arising on boundaries between machined surfaces and surfaces kept in bare surfaces by making the bottom surface of the intake pocket section lowered more than the bottom surface of the scroll chamber and forming the chamfer between them.

As described above, it is possible to prevent burrs from arising a side of a plate when a spiral base plate is machined, to reduce labor-hours for trimming, and to provide a low-cost scroll member according to the present invention. In addition, it is possible to eliminate machining of a spiral base plate on an extension line, and hence, to increase productivity. Hence, it is possible to provide a low-cost scroll member for a scroll type of fluid machinery.

In addition, it is possible to prevent burrs from arising in the base plate surface in a spiral end of a spiral outer wall, to reduce the labor-hours for trimming, and hence, to provide a low-cost scroll member for a scroll type of fluid machinery according to the present invention.

Furthermore it is possible to expand a passageway for intake gas and form smooth flow of the intake gas, to improve suction efficiency, and hence, to increase performance according to the present invention. It is also possible to increase balance of gas pressures in two scroll chambers. Further, it is possible to suppress a shell diameter in small size, and hence, to miniaturize a compressor. Furthermore, as described above, it is possible to prevent burrs from arising in an outer side of the base plate, and to eliminate machining of spiral base plate surface on an extension line of the spiral end of the spiral inner wall. Still more, it is possible to eliminate machining of an inside surface and the base plate surface of an intake pocket section, and, therefore, it is possible to greatly increase productivity and reduce labor-hours for trimming, and hence, to provide a low-cost scroll member for a scroll type of fluid machinery.

What is claimed is:

1. A scroll type of fluid machinery comprising:

a drive mechanism driven by a drive shaft, a scroll member having a first spiral element formed in a spiral shape around an axis and a first base plate provided in one piece on an end face of said first spiral element in an axial direction, and a counterpart scroll member having a second spiral element meshing with said first spiral element and a second base plate facing said first base plate, said drive mechanism performing rotation-prevented swing motion of said first spiral element relative to said counterpart scroll member so that said fluid machinery forms a fluid pocket between said first and said second spiral elements to compress fluid in said fluid pocket, wherein said scroll member has a first chamfered section formed in said base plate surface and extending along an extension line of an inner wall surface's spiral end of said spiral element to have an inner section and an outer section which are divided with respect to said extension line, said inner section having a width less than a thickness of said second spiral element, said first chamfered section having a bare surface.

2. The scroll type of fluid machinery according to claim 1, wherein said base plate surface is formed outside said first chamfered section at one step lower than said base plate surface inside said first spiral element, either of said outside base plate surface or a surface defining a circumference of said base plate surface being formed in a bare surface.

3. The scroll type of fluid machinery according to claim 1, wherein said scroll member has a second chamfered section formed in a bare surface on a wall surface corresponding to an inner wall's end section of said spiral element of said base plate.

4. The scroll type of fluid machinery according to claim 1, wherein said scroll member has a concave portion provided in a portion corresponding to an outer wall surface's end section of said spiral element of said base plate.

5. The scroll type of fluid machinery according to claim 4, wherein said scroll member has a third chamfered section formed in a bare surface in an area contacting to said concave section and at least one surface of said outer wall surface and a surface of said base plate, said outer wall and said surface of said base plate being machined toward said area.

6. The scroll type of fluid machinery according to claim 1, wherein said scroll member is a movable scroll member driven by said drive mechanism.

7. The scroll type of fluid machinery according to claim 1, wherein said scroll member is a fixed scroll member fixed in a casing.

8. The scroll type of fluid machinery according to claim 7, wherein said fixed scroll member is formed in one piece with said casing.

9. A scroll member having a spiral element formed in a spiral shape around an axis and a base plate provided in an end face of this spiral element in an axial direction in one piece, said scroll member having a first chamfered section formed in said base plate surface and extending along an extension line of an inner wall surface's spiral end of said spiral element to have an inner section and an outer section which are divided with respect to said extension line, said first chamfered section having a bare surface.

10. The scroll member according to claim 9, wherein said base plate surface is formed outside said first chamfered section at one step lower than a base plate surface inside said first spiral element, either of said outside base plate or a surface defining circumference of said base plate surface being formed in a bare surface.

11. The scroll member according to claim 9, further comprising a second chamfered section formed in a bare surface on a wall surface corresponding to an inner wall surface's end section of said spiral element of said base plate.

12. The scroll member according to claim 9, further comprising a concave portion provided in a portion corresponding to an outer wall surface's end section of said spiral element of said base plate.

13. The scroll member according to claim 12, further comprising a third chamfered section formed in a bare surface in an area contacting to said concave section and at least one surface of said outer wall surface and a surface of said base plate, said outer wall and said surface of said base plate being machined to said area.

14. The scroll member for a scroll type of fluid machinery according to claim 9, wherein said spiral element is a first spiral element formed in a spiral shape around an axis, said base plate is a first base plate provided in one piece on an end face of said first spiral element in an axial direction, said scroll member compressing fluid to forming a fluid pocket between said first spiral element and a second spiral element by performing swing motion, said swing motion being prevented from rotating relatively to a counterpart scroll member, said counterpart scroll member having said second spiral element meshing with said first spiral element and a second base plate facing to said first base plate.

15. The scroll member according to claim 14, wherein said inner section has a width less than a thickness of said second spiral element.

16. The scroll member according to claim 14, said scroll member being a movable scroll member, said counterpart scroll member being a fixed scroll member.

17. The scroll member according to claim 14, wherein said fixed scroll member is formed in one piece with a casing.

* * * * *